US007484821B2

(12) United States Patent
Sudo et al.

(10) Patent No.: US 7,484,821 B2
(45) Date of Patent: Feb. 3, 2009

(54) METHOD OF DETERMINING INK EJECTION METHOD, PRINTING APPARATUS, AND METHOD OF MANUFACTURING PRINTING APPARATUS

(75) Inventors: Naoki Sudo, Matsumoto (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 105 days.

(21) Appl. No.: 11/783,940

(22) Filed: Apr. 13, 2007

(65) Prior Publication Data

US 2007/0242098 A1 Oct. 18, 2007

(30) Foreign Application Priority Data

Apr. 13, 2006 (JP) ..... 2006-110901

(51) Int. Cl.
*B41J 29/38* (2006.01)

(52) U.S. Cl. ..... 347/13; 347/42; 347/12

(58) Field of Classification Search ..... 347/12, 347/13, 15, 41, 43
See application file for complete search history.

(56) References Cited

U.S. PATENT DOCUMENTS 6,338,544 B1 * 1/2002 Drake et al. ..... 347/41
6,386,668 B1 * 5/2002 Shimizu et al. ..... 347/13
6,578,950 B2 6/2003 Matsumoto et al.
6,598,951 B2 * 7/2003 Ikemoto et al. ..... 347/13
6,834,932 B2 * 12/2004 Silverbrook et al. ..... 347/42

FOREIGN PATENT DOCUMENTS

JP 2002-144542 A 5/2002
JP 2003-334939 A 11/2003
JP 2006-36731 A 2/2006

* cited by examiner

*Primary Examiner*—Lamson D Nguyen
(74) *Attorney, Agent, or Firm*—Sughrue Mion, PLLC

(57) ABSTRACT

Density unevenness caused in an image formed with an overlap portion of nozzles is suppressed. For this purpose, a method of determining an ink ejection method includes: transporting a medium in a transporting direction; forming an image with a nozzle unit having a plurality of nozzle rows in which a plurality of nozzles for ejecting ink are arranged at a predetermined interval in an intersecting direction intersecting the transporting direction, wherein the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction; and determining an ink ejection method from the nozzles in the overlap area, based on a density of the image.

11 Claims, 16 Drawing Sheets

METHOD OF DETERMINING INK EJECTION METHOD, PRINTING APPARATUS, AND METHOD OF MANUFACTURING PRINTING APPARATUS

CROSS-REFERENCE TO RELATED APPLICATIONS

The present application claims priority upon Japanese Patent Application No. 2006-110901 filed on Apr. 13, 2006, which is herein incorporated by reference.

TECHNICAL FIELD

The present invention relates to a method of determining an ink ejection method, a printing apparatus for forming an image by ejecting ink onto a medium, and a method of manufacturing a printing apparatus.

RELATED ART

Inkjet printers are known as one type of printing apparatus for forming an image by ejecting ink onto a medium. Among such inkjet printers, there is a printer having an ink ejection head in which nozzles are provided at the entire area in a width direction intersecting a transporting direction of a medium on which an image is to be formed. In a printer provided with nozzles at the entire area in the width direction of a medium, the interval between the nozzles often corresponds to the resolution of an image, and thus the positional precision of the nozzles has a direct influence on the image. However, it is difficult to integrally form, at high precision, an ink ejection head having nozzles at the entire area of the width (210 mm) in the width direction of A4 size paper, for example. Furthermore, even if produced, such an ink ejection head is very expensive. Thus, a nozzle unit is used in which a plurality of ink ejection heads with a width sufficiently narrower than the width of A4 size paper are provided, these ink ejection heads are arranged in the width direction of a medium, and nozzles arranged on an end side in the ink ejection heads are overlapped with each other in the width direction (see JP-A-2006-36731, for example).

In an ink ejection head having a plurality of nozzles, even if the length of a nozzle row in which nozzles are successively arranged is sufficiently narrower than the width of A4 size, due to its structure, the amount of ink ejected from nozzles arranged on the end portion side in the nozzle rows may be different from that of nozzles arranged at positions other than the end portion, when ink is ejected based on the same print signal.

In the conventional printer described above, an image is printed using nozzles arranged on an end portion side in nozzle rows at the boundary between adjacent ink ejection heads. Thus, even when an image with uniform density is to be printed, density unevenness may be caused in a printed image.

SUMMARY

The invention was achieved in view of the above-described problems, and it is an advantage thereof to realize a printing apparatus, a printing system, and a method for determining an ink ejection method that suppress density unevenness caused in an image formed with an overlap portion of nozzles.

A primary aspect of the invention is a method of determining an ink ejection method, comprising:

transporting a medium in a transporting direction;

forming an image with a nozzle unit having a plurality of nozzle rows in which a plurality of nozzles for ejecting ink are arranged at a predetermined interval in an intersecting direction intersecting the transporting direction, wherein the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction; and determining an ink ejection method from the nozzles in the overlap area, based on a density of the image.

Another aspect of the invention is a printing apparatus, comprising:

(A) a transporting section that transports a medium in a transporting direction;

(B) a nozzle unit having a plurality of nozzle rows in which a plurality of nozzles for ejecting ink are arranged at a predetermined interval in an intersecting direction intersecting the transporting direction, wherein the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction; and (C) a controller that determines an ink ejection method from the nozzles in the overlap area, based on a density of an image that has been formed with ink that has been ejected onto the medium.

Another aspect of the invention is a method of manufacturing a printing apparatus, comprising:

transporting a medium in a transporting direction using the printing apparatus;

forming an image with a nozzle unit having a plurality of nozzle rows in which a plurality of nozzles for ejecting ink are arranged at a predetermined interval in an intersecting direction intersecting the transporting direction, wherein the nozzle unit is provided in the printing apparatus, the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction;

determining an ink ejection method from the nozzles in the overlap area, based on a density of the image; and causing a memory provided in the printing apparatus to store information relating to the determined ink ejection method.

Other features of the invention will become clear by reading the description of the present specification with reference to the accompanying drawings.

DESCRIPTION OF EMBODIMENTS

Figure 1:
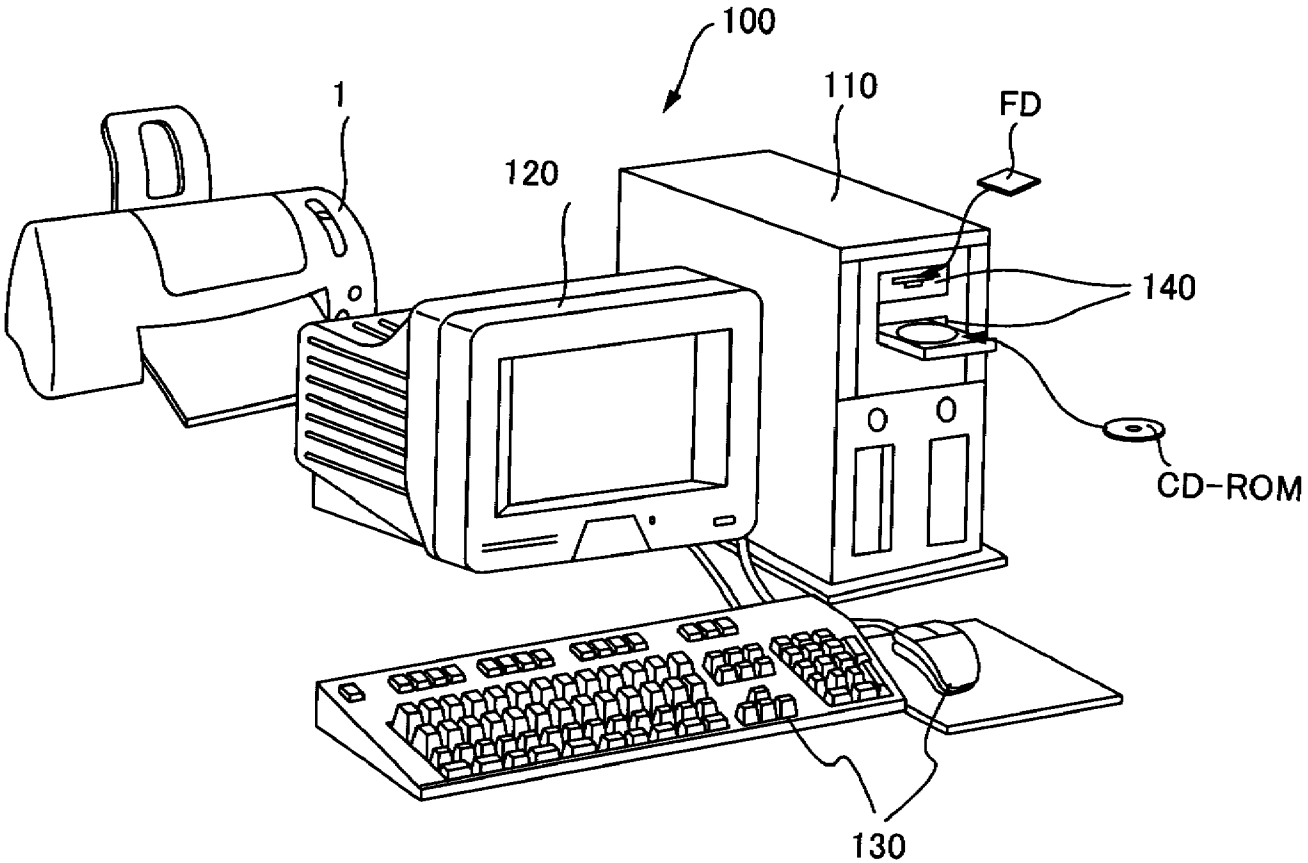
FIG. 1 is an explanatory diagram showing the external configuration of a printing system.

At least the following matters will be made clear by the explanation in the present specification and the description of the accompanying drawings.

A method for determining an ink ejection method comprises:

transporting a medium in a transporting direction;

forming an image with a nozzle unit having a plurality of nozzle rows in which a plurality of nozzles for ejecting ink are arranged at a predetermined interval in an intersecting direction intersecting the transporting direction, wherein the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction; and determining an ink ejection method from the nozzles in the overlap area, based on a density of the image.

With this method for determining an ink ejection method, the ink ejection method from the nozzles in the overlap area is determined based on the density of a printed image. Thus, the ink ejection method can be determined according to the ink ejection characteristics of the nozzles in the overlap area.

In particular, the position of a nozzle in a particular nozzle row in the overlap area and the position of a nozzle in another nozzle row are different from each other in the intersecting direction, and thus ink ejected from the nozzle in the particular nozzle row and ink ejected from the nozzle in the other nozzle row can be ejected onto different positions on a medium.

Thus, a plurality of types of ink ejection methods can be set, so that a more appropriate ink ejection method can be determined according to the ejection characteristics of ink from the nozzles. Accordingly, occurrence of density unevenness can be suppressed.

In the method for determining an ink ejection method, it is preferable that the image is formed with ink that has been ejected from the nozzles in the overlap area.

With this method for determining an ink ejection method, the ink ejection method from the nozzles in the overlap area is determined based on the density of an image formed with ink ejected from the nozzles in the overlap area, so that an appropriate ink ejection method can be determined according to an actually formed image.

In the method for determining an ink ejection method, it is preferable that the nozzles form an image based on print data, and the image is a specific density image that has been formed based on the print data for forming an image with a predetermined density.

With this method for determining an ink ejection method, the specific density image is to have a predetermined density that is substantially uniform. Thus, it is possible to easily judge whether or not a proper image is formed, by judging whether or not an image formed based on the print data for forming the specific density image has a predetermined density.

In the method for determining an ink ejection method, it is preferable that the specific density image is formed by causing ink to be ejected from the nozzles such that a dot to be formed on the medium with ink ejected from the nozzle in the particular nozzle row in the overlap area and a dot to be formed on the medium with ink ejected from the nozzle in the other nozzle row are alternately arranged in the transporting direction.

In an image in which a dot formed with ink ejected from a nozzle in a particular nozzle row in the overlap area and that formed with a nozzle in another nozzle row are alternately arranged, the ejection characteristics of ink from each of the nozzle rows are less noticeable, so that this method is appropriate as an ink ejection method for printing an image. Since the ink ejection method in the overlap area is determined based on the specific density image printed by this ink ejection method, occurrence of density unevenness can be effectively suppressed.

In the method for determining an ink ejection method, it is preferable that in a case where a density of the image is lower than a preset density, ink is caused to be ejected from the nozzle in the particular nozzle row and the nozzle in the other nozzle row in the overlap area.

With this method for determining an ink ejection method, in a case where the density of the formed specific density image is low, two dots at different positions in the intersecting direction are formed at an area at which one dot is to be formed. Thus, the density of an image that is to be formed can be increased.

In the method for determining an ink ejection method, it is preferable that an amount of ink caused to be ejected is different between the nozzle in the particular nozzle row and the nozzle in the other nozzle row in the overlap area.

With this method for determining an ink ejection method, since the size of a dot formed with ink ejected from a nozzle in a particular nozzle row is different from the size of a dot formed with ink ejected from a nozzle in another nozzle row, the density of an image that is to be formed can be changed between multiple levels.

In the method for determining an ink ejection method, it is preferable that in a case where a density of the image is higher than a preset density, an amount of ink caused to be ejected from the nozzle is reduced in either one of the particular nozzle row and the other nozzle row in the overlap area.

With this method for determining an ink ejection method, in a case where the density of an image is higher than a preset density, the amount of ink ejected from nozzles is reduced in either one of a particular nozzle row and another nozzle row. Thus, the density of an image that is to be formed can be reliably lowered.

It is preferable that the method for determining an ink ejection method further comprises detecting a density of the image. With this method for determining an ink ejection method, the ink ejection method from the nozzles in the overlap area can be determined by detecting the density of the formed specific density image.

In the method for determining an ink ejection method, in a case where an image formed with ink ejected from the nozzles in the overlap area contains a high density portion with a density higher than a preset density and a low density portion with a density lower than the preset density, an ink ejection method for a case where density of an image is higher than the preset density may be applied to the nozzle used for forming the high density portion, and an ink ejection method for a case where density of an image is lower than the preset density may be applied to the nozzle used for forming the low density portion.

Furthermore, a printing apparatus comprises:

(A) a transporting section that transports a medium in a transporting direction;

(B) a nozzle unit having a plurality of nozzle rows in which a plurality of nozzles for ejecting ink are arranged at a predetermined interval in an intersecting direction intersecting the transporting direction, wherein the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction; and (C) a controller that determines an ink ejection method from the nozzles in the overlap area, based on a density of an image that has been formed with ink that has been ejected onto the medium.

Furthermore, a method of manufacturing a printing apparatus comprises:

transporting a medium in a transporting direction using the printing apparatus;

forming an image with a nozzle unit having a plurality of nozzle rows in which a plurality of nozzles for ejecting ink are arranged at a predetermined interval in an intersecting direction intersecting the transporting direction, wherein the nozzle unit is provided in the printing apparatus, the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction;

determining an ink ejection method from the nozzles in the overlap area, based on a density of the image; and causing a memory provided in the printing apparatus to store information relating to the determined ink ejection method.

Configuration of the Printing System

An embodiment of a printing system is described with reference to the drawings. It should be noted that the description of the following embodiments also encompasses embodiments relating to a computer program and a storage medium storing the computer program, for example.

FIG. 1 is an explanatory diagram showing the external configuration of a printing system. A printing system 100 is provided with a printer 1, a computer 110, a display device 120, input devices 130, and recording/reproducing devices 140. The printer 1 is a printing apparatus for printing an image on a medium such as paper, cloth, or film. The computer 110 is communicably connected to the printer 1, and outputs print data corresponding to an image that is to be printed, to the printer 1 in order to cause the printer 1 to print that image.

A printer driver is installed on the computer 110. The printer driver is a program for causing the display device 120 to display a user interface and for causing image data output from an application program to be converted into print data. The printer driver is stored in a storage medium (computer-readable storage medium) such as a flexible disk FD or a CD-ROM. Alternatively, the printer driver also can be downloaded onto the computer 110 via the Internet. It should be noted that this program is constituted by codes for realizing various functions.

Herein, the "printing apparatus" refers to an apparatus for printing an image on a medium, and examples thereof include the printer 1. Furthermore, a "printing control device" refers to a device for controlling the printing apparatus, and examples thereof include the printer 1, and a computer on which a printer driver corresponding to the printer 1 is installed, in this embodiment. The "printing system" refers to a system that includes at least the printing apparatus and the printing control device.

Configuration of the Printer

Configuration of the Inkjet Printer

Figure 2:
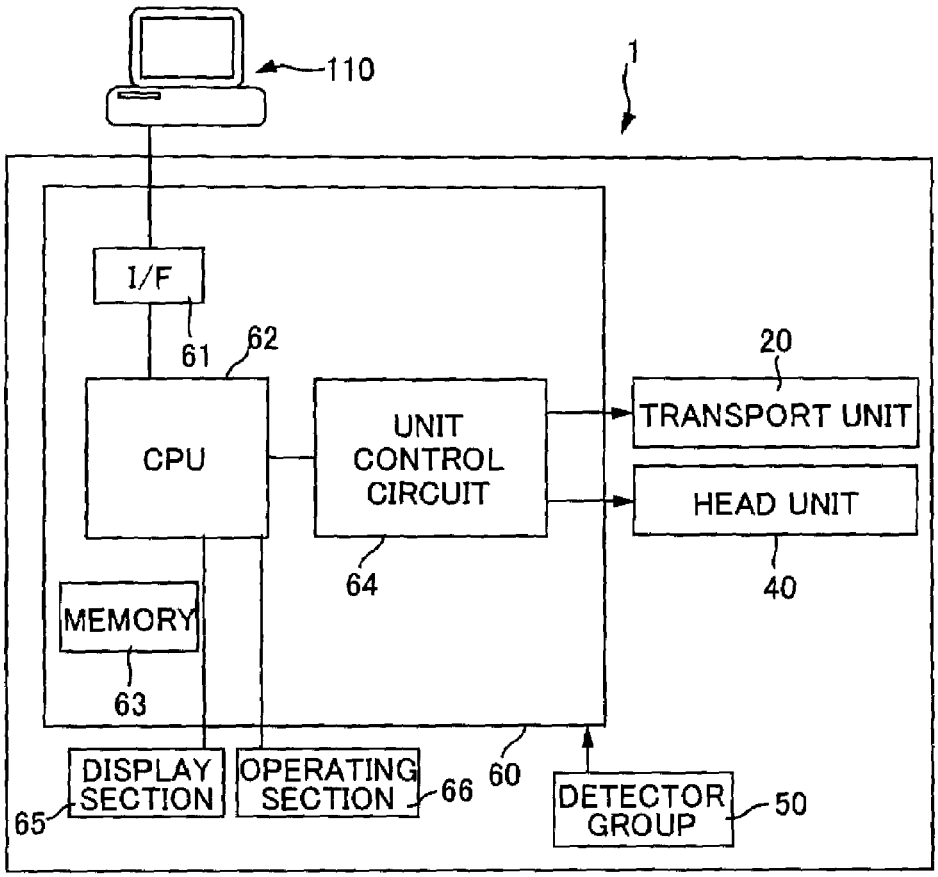
FIG. 2 is a block diagram of the overall configuration of the printer.
Figure 3:
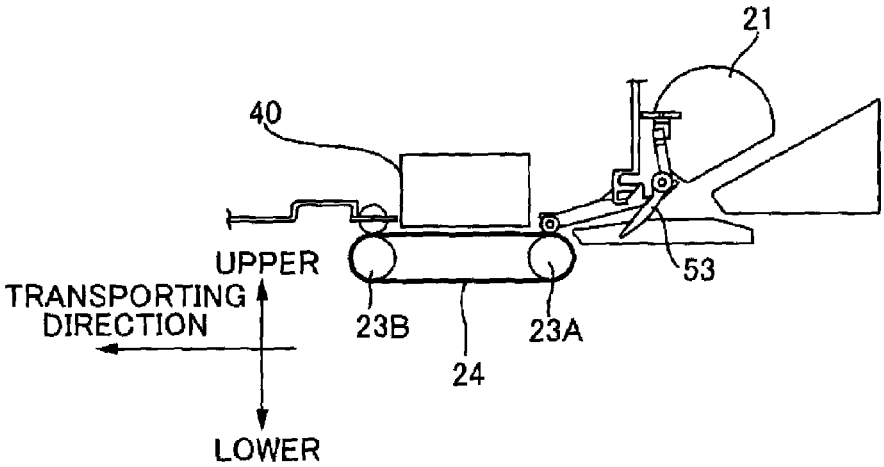
FIG. 3 is a cross-sectional view of the printer.
Figure 4:
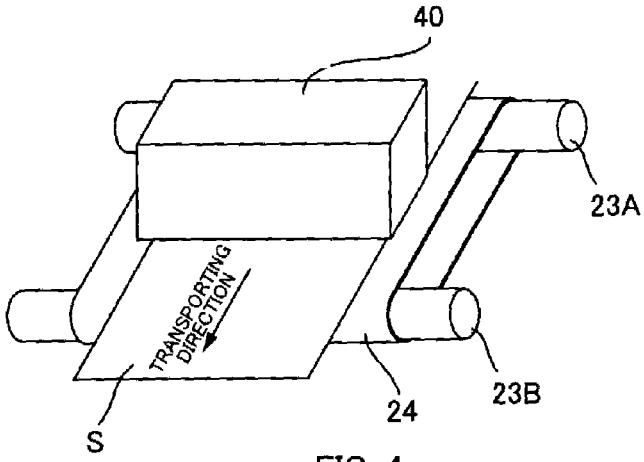
FIG. 4 is a perspective view for illustrating a transporting process and a dot forming process of the printer.

FIG. 2 is a block diagram of the overall configuration of the printer. FIG. 3 is a cross-sectional view of the printer. FIG. 4 is a perspective view for illustrating a transporting process and a dot forming process of the printer. Hereinafter, the basic configuration of a line printer, serving as the printer of this embodiment, is described.

The printer 1 of this embodiment has a transport unit 20, a head unit (nozzle unit) 40, a detector group 50, a display section 65, an operating section 66, and a controller 60. The printer 1 that has received print data from the computer 110, which is an external device, controls the units (the transport unit 20, and the head unit 40) using the controller 60. The controller 60 controls the units based on the print data received from the computer 110, to form an image on paper. The detector group 50 monitors the conditions within the printer 1, and outputs the detection results to the controller 60. The controller 60 controls the units based on the detection results output from the detector group 50.

The transport unit 20 is for transporting a medium (for example, such as paper S) in a predetermined direction (hereinafter referred to as a "transporting direction"). The transport unit 20 has a paper feed roller 21, a transport motor (not shown), an upstream-side transport roller 23A, a downstream-side transport roller 23B, and a belt 24. The paper feed roller 21 is a roller for feeding paper that has been inserted into a paper insert opening into the printer. When the transport motor (not shown) rotates, the upstream-side transport roller 23A and the downstream-side transport roller 23B rotate, and the belt 24 rotates. The paper S that has been fed by the paper feed roller 21 is transported by the belt 24 up to a printable area (area opposed to the head). When the belt 24 transports the paper S, the paper S moves in the transporting direction with respect to the head unit 40. The paper S that has passed through the printable area is discharged to the outside by the belt 24. The paper S that is being transported is electrostatically-adsorbed or vacuum-adsorbed to the belt 24.

The head unit 40 is for ejecting ink onto the paper S. The head unit 40 has a plurality of nozzles for ejecting ink. When ink is ejected from the nozzles onto the paper S that is being transported, dots are formed on the paper S, so that an image is printed on the paper S. The printer of this embodiment is a line printer, and the head unit 40 can simultaneously form dots at a predetermined resolution in an area for the paper width. The configuration of the head unit 40 is described later.

The detector group 50 includes a rotary encoder (not shown), and a paper detection sensor 53, for example. The rotary encoder detects the rotation amount of the upstream-side transport roller 23A and the downstream-side transport roller 23B. Based on the detection results of the rotary encoder, the transport amount of the paper S can be detected. The paper detection sensor 53 detects the position of the front end of the paper that is being fed.

The controller 60 is a control unit (controller) for controlling the printer. The controller 60 has an interface section 61, a CPU 62, a memory 63, and a unit control circuit 64. The interface section 61 exchanges data between the computer 110, which is an external device, and the printer 1. The CPU 62 is a processing unit for performing the overall control of the printer. The memory 63 is for securing an area for storing programs for the CPU 62 and a work area, for example, and has storage elements such as a RAM or an EEPROM. The CPU 62 controls each unit via the unit control circuit 64 according to a program stored in the memory 63. Furthermore, the controller 60 also performs an ejecting method determining process of determining an ink ejection method from the nozzles in order to print an image. The ejecting method performing process is described later.

Configuration of the Head Unit (Nozzle Unit) 40

Figure 5:
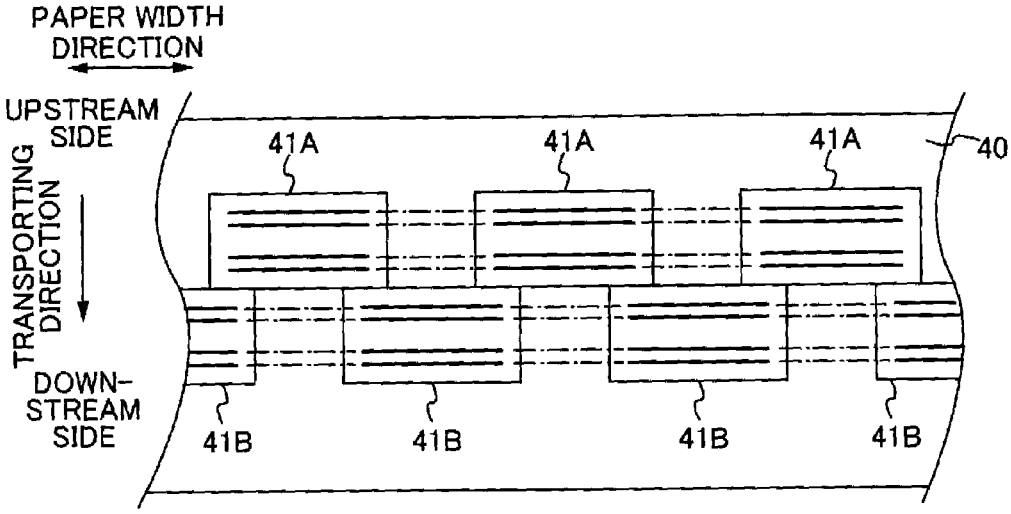
FIG. 5 is an explanatory diagram of the positional relationship between the heads.
Figure 6:
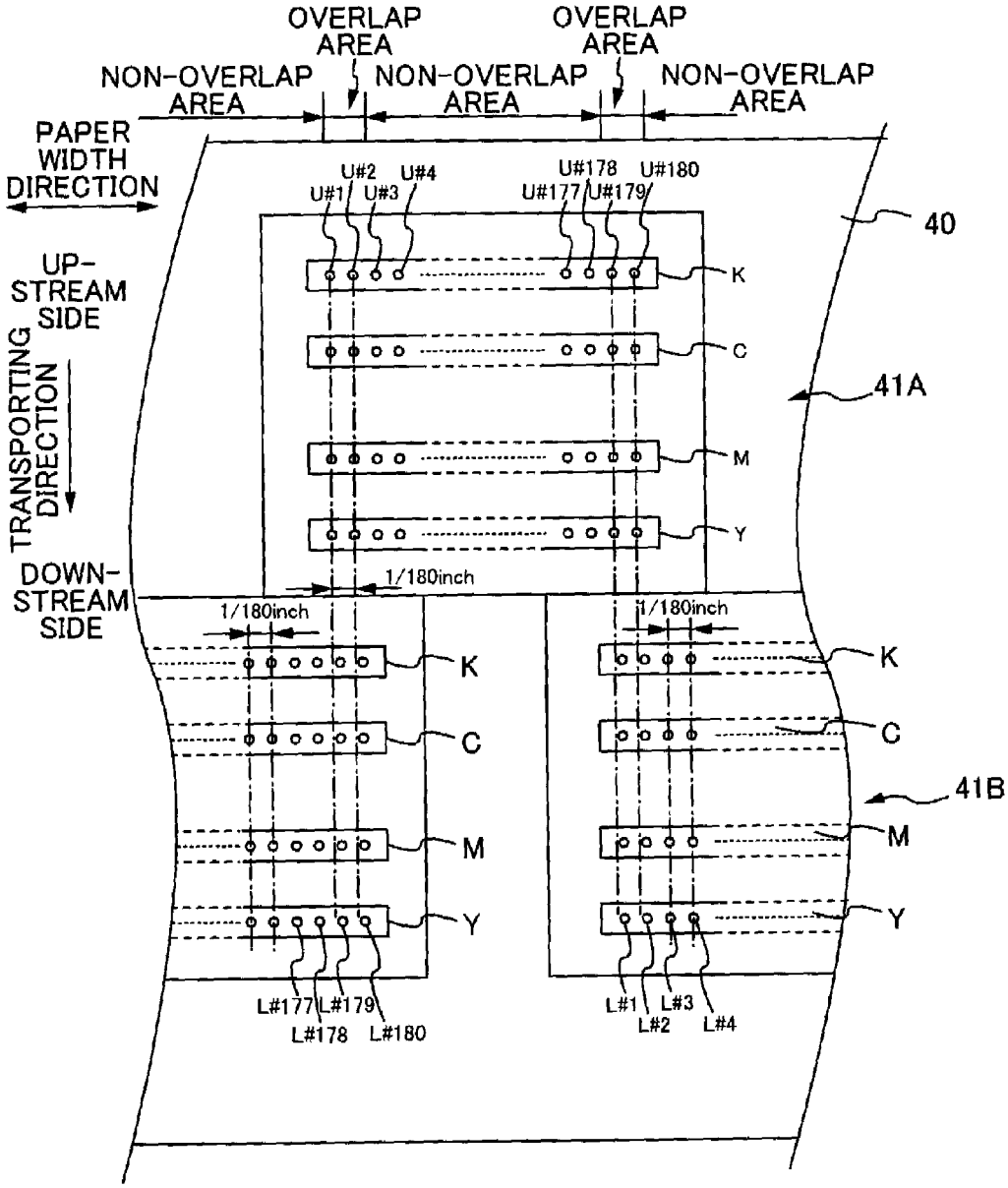
FIG. 6 is a flowchart of processes during printing.

FIG. 5 is an explanatory diagram illustrating the arrangement of a plurality of heads on a lower face of the head unit. FIG. 6 is an explanatory diagram of the positional relationship between the heads. The lower face of the head unit is opposed to the paper S that is transported on the belt 24.

On the lower face of the head unit 40, a plurality of heads 41A and a plurality of heads 41B are arranged in a checkered pattern, the heads 41A being arranged in an intersecting direction intersecting the transporting direction on the upstream side in the transporting direction, and the heads 41B being arranged in the intersecting direction on the downstream side in the transporting direction.

In each head, a black ink nozzle row K, a cyan ink nozzle row C, a magenta ink nozzle row M, and a yellow ink nozzle row Y are formed. Each nozzle row is provided with a plurality of nozzles (in this embodiment, 180), which are ejection openings for ejecting ink. The plurality of nozzles in each nozzle row are arranged at a constant nozzle pitch in the intersecting direction. In this embodiment, the nozzle pitch is 1/180 inch. For the sake of convenience, the nozzles of each head are sequentially numbered from left in FIG. 6 (U#1 to U#180, L#1 to L#180).

The nozzle rows of the upstream-side heads 41A and the nozzle rows of the downstream-side heads 41B are configured such that nozzles on an end portion side in the intersecting direction are overlapped with each other. In this embodiment, a nozzle for forming a dot that is to be formed at a particular position in the intersecting direction is set in each of the upstream-side head 41A and the downstream-side head 41B. The nozzle provided in the upstream-side head 41A and the nozzle provided in the downstream-side head 41B, for forming a dot that is to be formed at a particular position in the intersecting direction, are arranged such that their positions are slightly different from each other in the intersecting direction. In the following description, an area in which a nozzle for forming a dot that is to be formed at a particular position in the intersecting direction is set in each of the upstream-side head 41A and the downstream-side head 41B is referred to as an overlap area.

More specifically, two nozzles (U#1 and U#2) in a left end portion that is on one end side in the intersecting direction in the upstream-side head 41A and two nozzles (L#179 and L#180) in a right end portion that is on the other end side in the intersecting direction in the downstream-side head 41B are arranged overlapped with each other. The nozzle U#1 of the upstream-side head 41A and the nozzle L#179 of the downstream-side head 41B are set as nozzles for forming a dot that is to be formed at a particular position in the intersecting direction. The nozzle U#2 of the upstream-side head 41A and the nozzle L#180 of the downstream-side head 41B are set as nozzles for forming a dot that is to be formed at a particular position in the intersecting direction. Furthermore, the nozzle U#179 of the upstream-side head 41A and the nozzle L#1 of the downstream-side head 41B are set as nozzles for forming a dot that is to be formed at a particular position in the intersecting direction. The nozzle U#180 of the upstream-side head 41A and the nozzle L#2 of the downstream-side head 41B are set as nozzles for forming a dot that is to be formed at a particular position in the intersecting direction. The nozzle of the upstream-side head 41A and the nozzle of the downstream-side head 41B set as nozzles for forming a dot that is to be formed at a particular position in the intersecting direction are arranged such that their positions are slightly different from each other in the intersecting direction.

Which head in the overlap area is used for printing by ejecting ink from the nozzle in that head to form a dot at a particular position in the intersecting direction is stored in the memory in advance by performing a predetermined process of determining an ink ejection method in an adjusting step during production, for example.

Influence of Nozzles in the Overlap Area on Images:

Conventional Printer

Herein, the influence of dots formed with nozzles in the overlap area on an image is described. In the following description, an image formed with a nozzle row (nozzle row on the upstream side) of the upstream-side head 41A and a nozzle row (nozzle row on the downstream side) of the downstream-side head 41B that is adjacent to this upstream-side head 41A is described.

First, an example is described in which as in a conventional printer, a nozzle in a nozzle row on the upstream side and a nozzle in a nozzle row on the downstream side are arranged in a straight line in the transporting direction, in the overlap area. At that time, it is assumed that the same amount of ink is ideally ejected based on the same print data, from the nozzles formed in the overlap area, that is, the nozzles arranged on the end portion side in the nozzle rows, and the nozzles arranged in an area other than the overlap area (hereinafter, referred to as a "non-overlap area"). Furthermore, it is assumed that for an image that is to be printed in the overlap area, an ink ejection method is applied by which a dot formed on paper with ink ejected from a nozzle in the nozzle row on the upstream side in the overlap area and a dot formed on the paper with ink ejected from a nozzle in the nozzle row on the downstream side are alternately arranged in the transporting direction.

Figure 7:
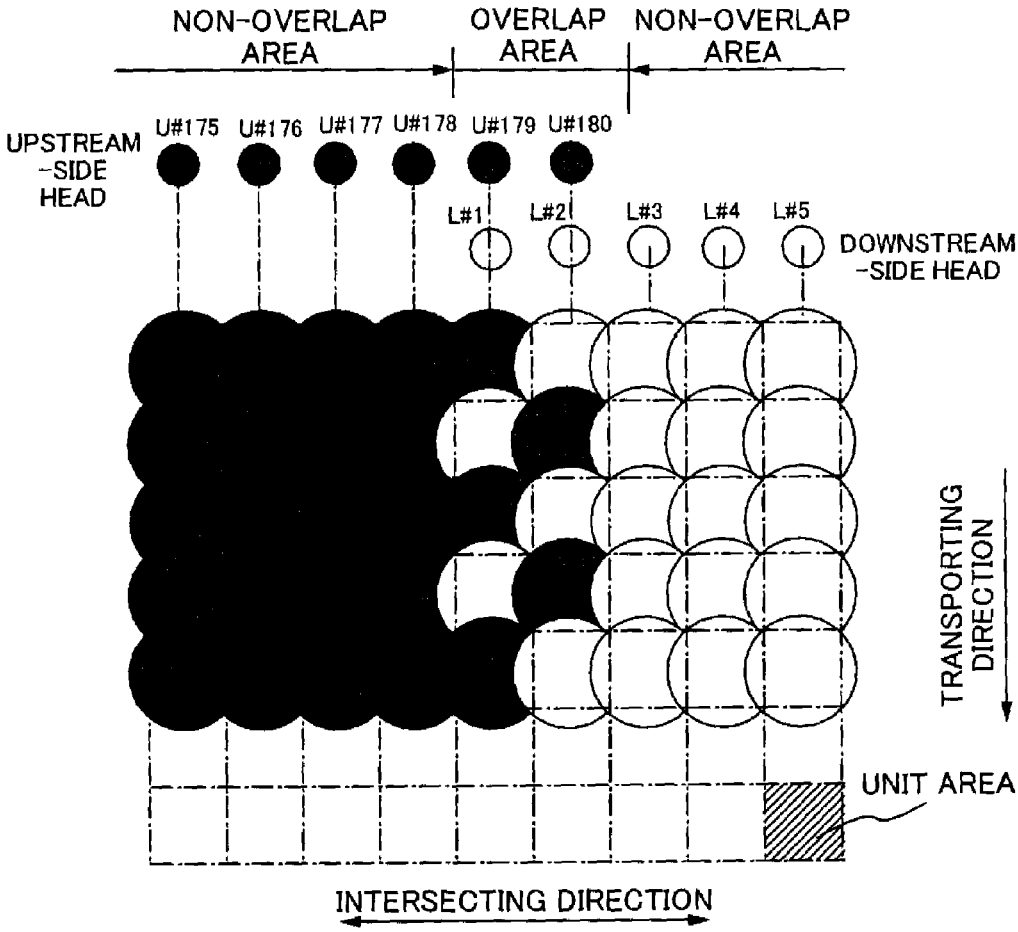
FIG. 7 is a diagram illustrating a concept of an image formed in a case where ink is ejected similarly from nozzles in an overlap area and nozzles in a non-overlap area, in a conventional printer.

FIG. 7 is a diagram illustrating a concept of an image formed in a case where ink is ejected similarly from the nozzles in the overlap area and the nozzles in the non-overlap area, in the conventional printer. In the drawings below, a virtual area (hereinafter, referred to as a "unit area") at which each pixel constituting an image is to be formed on paper is defined by a dashed dotted line in a lattice form. On the lattice, a dot formed with a head on the upstream side is indicated as a gray circle, and a dot formed with a head on the downstream side is indicated as a white circle. The circles outside the lattice indicate the positions of nozzles.

In a case where ink is ejected similarly from the overlap area and the non-overlap area, when ink is ejected based on print data for ejecting the same amount of ink from the nozzles, dots are formed in a substantially uniform manner throughout the entire area of paper as shown in FIG. 7, and thus an image with substantially uniform density is formed.

Figure 8:
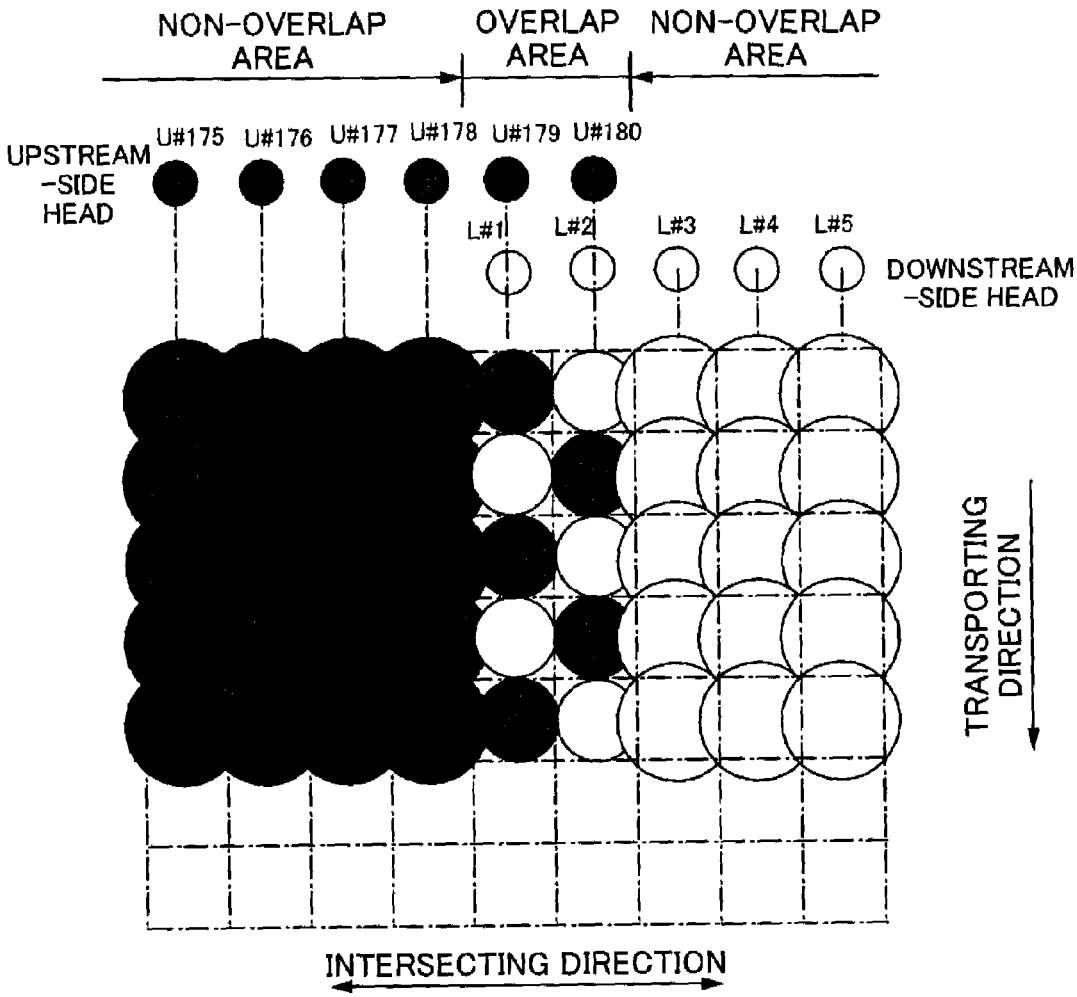
FIG. 8 is a diagram illustrating a concept of an image formed in a case where the amount of ink ejected from the nozzles in the overlap area is smaller than the amount of ink ejected from the nozzles in the non-overlap area, in the conventional printer.

FIG. 8 is a diagram illustrating a concept of an image formed in a case where the amount of ink ejected from the nozzles in the overlap area is smaller than the amount of ink ejected from the nozzles in the non-overlap area, in the conventional printer. Also in FIG. 8, an image is shown that is formed in a case where the nozzles U#179 and U#180 of a head on the upstream side in the overlap area and the nozzles L#1 and L#2 of a head on the downstream side are ideally arranged in lines in the transporting direction, in the conventional printer. Furthermore, it is assumed that for an image that is to be printed in the overlap area, the same ink ejection method as in FIG. 7 is applied by which a dot formed on paper with ink ejected from a nozzle in the nozzle row on the upstream side in the overlap area and a dot formed on the paper with ink ejected from a nozzle in the nozzle row on the downstream side are alternately arranged in the transporting direction.

The amount of ink ejected from the nozzles in the overlap area is smaller than the amount of ink ejected from the nozzles in the non-overlap area. Thus, as shown in FIG. 8, dots formed with ink ejected from the nozzles in the overlap area are smaller than dots formed with ink ejected from the nozzles in the non-overlap area. Accordingly, an underlying portion is exposed between dots, so that an image with density lower than that of an image that is to be printed is printed. At that time, smaller dots are formed with the nozzles in the overlap area. In the overlap area, two nozzles capable of forming dots are provided for each unit area. Thus, it is also possible to form dots by ejecting ink from two nozzles in the overlap area onto one unit area. However, in the conventional printer, even when ink is ejected from two nozzles, ink is newly ejected on a dot that has been already formed. When ink is ejected in this manner on a dot that has been already formed, the size of the dot does not increase so much, because ink hardly spreads to its surrounding area due to the characteristics of ink. Thus, the underlying portion remains between dots, so that the density of a portion formed with the nozzles in the overlap area becomes low.

Figure 9:
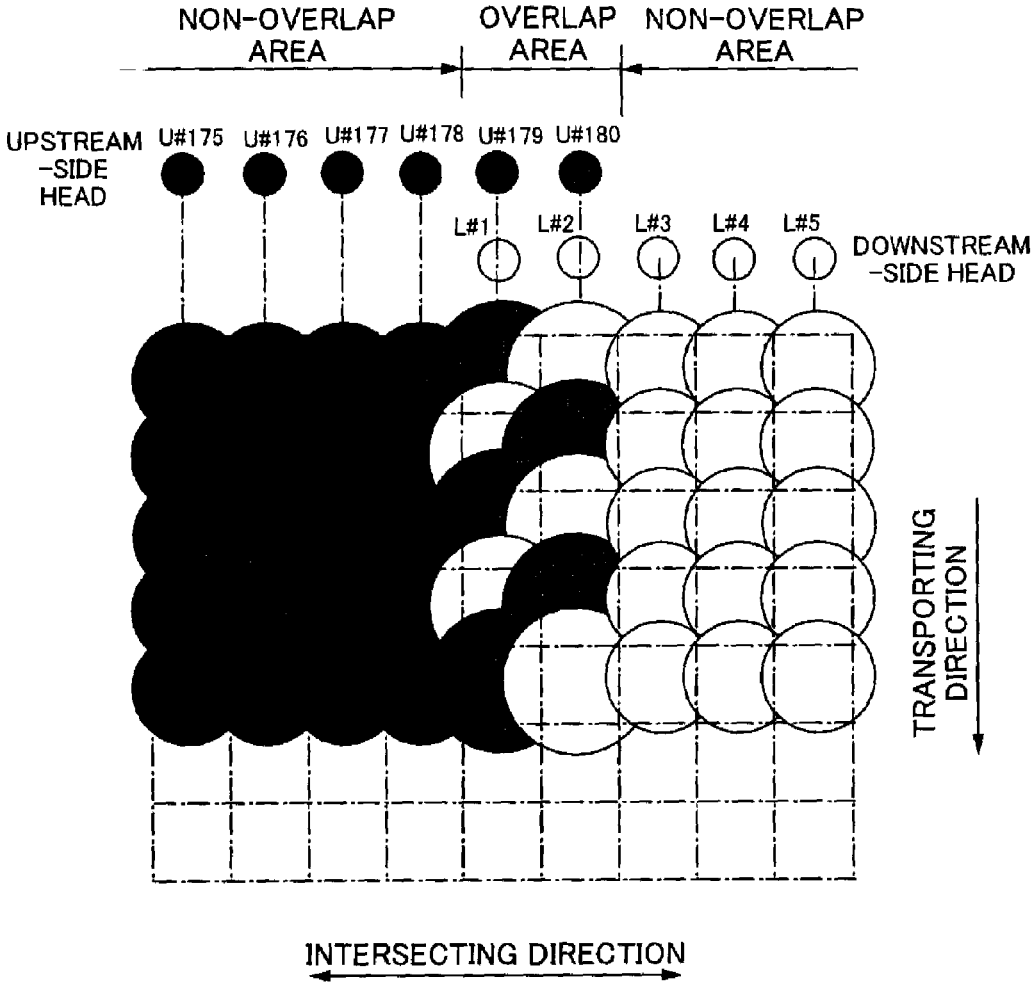
FIG. 9 is a diagram illustrating a concept of an image formed in a case where the amount of ink ejected from the nozzles in the overlap area is larger than the amount of ink ejected from the nozzles in the non-overlap area, in the conventional printer.

FIG. 9 is a diagram illustrating a concept of an image formed in a case where the amount of ink ejected from the nozzles in the overlap area is larger than the amount of ink ejected from the nozzles in the non-overlap area, in the conventional printer. It is assumed that for an image that is to be printed in the overlap area, the same ink ejection method as in FIGS. 7 and 8 is applied by which a dot formed on paper with ink ejected from a nozzle in the nozzle row on the upstream side in the overlap area and a dot formed on the paper with ink ejected from a nozzle in the nozzle row on the downstream side are alternately arranged in the transporting direction.

The amount of ink ejected from the nozzles in the overlap area is larger than the amount of ink ejected from the nozzles in the non-overlap area. Thus, as shown in FIG. 9, dots formed with ink ejected from the nozzles in the overlap area are larger than dots formed with ink ejected from the nozzles in the non-overlap area. Accordingly, the area of adjacent dots overlapped becomes larger. Thus, an image with density higher than that of an image that is to be printed is printed.

Thus, in the printer 1 of this embodiment, as described above, the nozzle of the upstream-side head 41A (nozzle row on the upstream side) and the nozzle of the downstream-side head 41B (nozzle row on the downstream side) are arranged such that their positions are slightly different from each other in the intersecting direction.

Influence of Nozzles in the Overlap Area on Images:

Printer of this Embodiment

Hereinafter, the concept of an image formed with the printer of this embodiment is described. Herein, it is assumed that for an image that is to be printed in the overlap area, an ink ejection method is applied by which a dot formed on paper with ink ejected from the nozzles U#179 and U#180 in the nozzle row on the upstream side in the overlap area and a dot formed on the paper with ink ejected from the nozzles L#1 and L#2 in the nozzle row on the downstream side are alternately arranged in the transporting direction. In the following description, this ink ejection method is referred to as a first ink ejection method.

Figure 10:
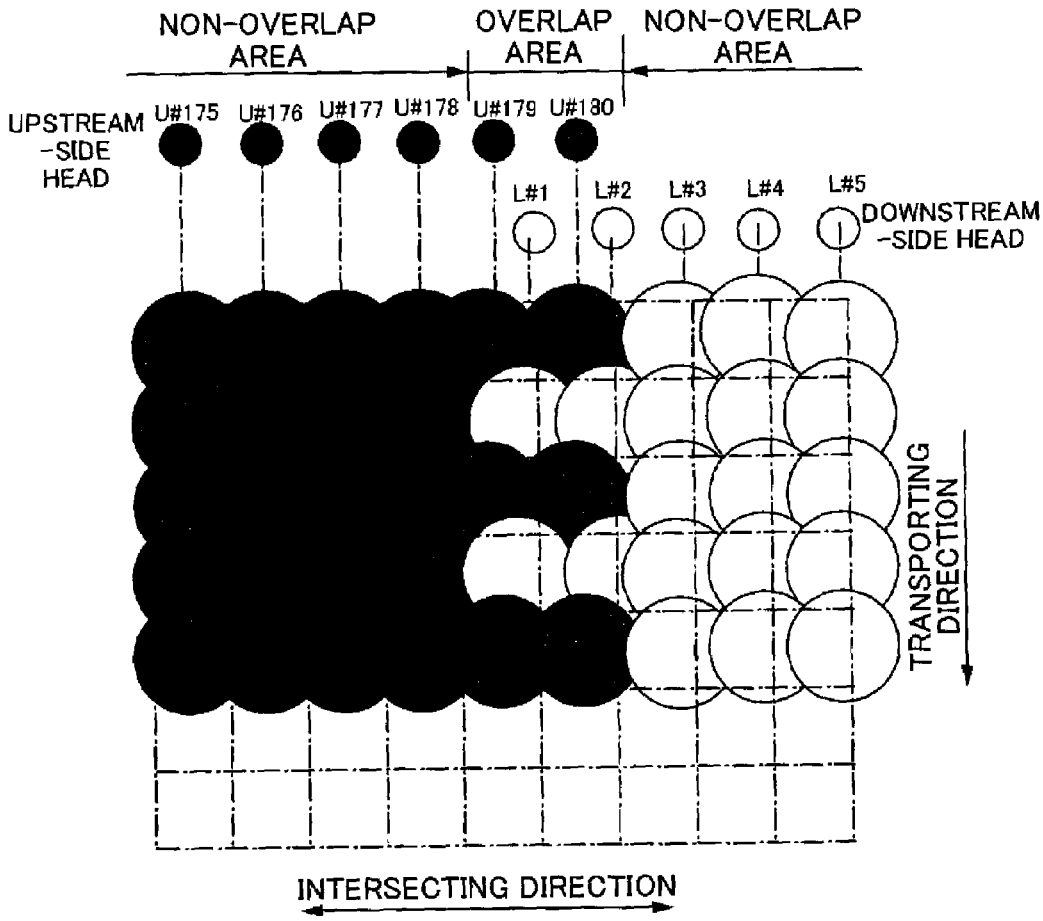
FIG. 10 is a diagram illustrating a concept of an image formed in a case where ink is ejected similarly from the nozzles in the overlap area and the nozzles in the non-overlap area, in the printer of this embodiment.

FIG. 10 is a diagram illustrating a concept of an image formed in a case where ink is ejected similarly from the nozzles in the overlap area and the nozzles in the non-overlap area, in the printer of this embodiment.

In a case where ink is ejected similarly from the overlap area and the non-overlap area, when ink is ejected based on print data for ejecting the same amount of ink from the nozzles, a dot formed with the nozzles U#179 and U#180 in the nozzle row on the upstream side in the overlap area and a dot formed with the nozzles L#1 and L#2 in the nozzle row on the downstream side are at different positions in the intersecting direction. However, also with the printer 1 of this embodiment, dots are formed in a substantially uniform manner throughout the entire area of paper as shown in FIG. 10, and thus an image with substantially uniform density is formed, as in the conventional printer.

Figure 11:
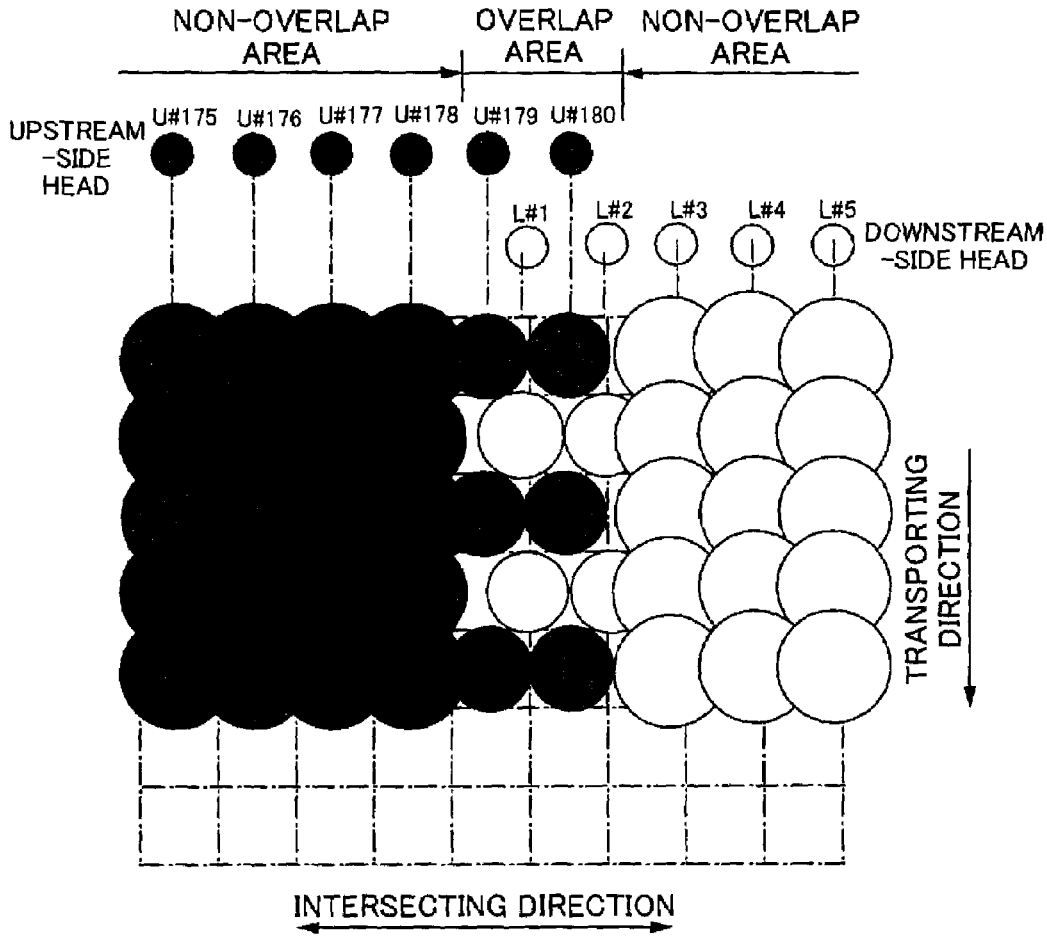
FIG. 11 is a diagram illustrating a concept of an image formed in a case where the amount of ink ejected from the nozzles in the overlap area is smaller than the amount of ink ejected from the nozzles in the non-overlap area, in the printer of this embodiment.

FIG. 11 is a diagram illustrating a concept of an image formed in a case where the amount of ink ejected from the nozzles in the overlap area is smaller than the amount of ink ejected from the nozzles in the non-overlap area, in the printer of this embodiment.

The amount of ink ejected from the nozzles in the overlap area is smaller than the amount of ink ejected from the nozzles in the non-overlap area. Thus, as shown in FIG. 11, also with the printer of this embodiment, an underlying portion is exposed between dots, so that an image with density lower than that of an image that is to be printed is formed, as in the conventional printer.

However, in the printer 1 of this embodiment, the nozzles U#179 and U#180 of the upstream-side head 41A (nozzle row on the upstream side) and the nozzles L#1 and L#2 of the downstream-side head 41B (nozzle row on the downstream side) are arranged such that their positions are slightly different from each other in the intersecting direction. Thus, it is possible to form dots at different positions in the intersecting direction, by ejecting ink from each of two nozzles onto one unit area.

Figure 12:
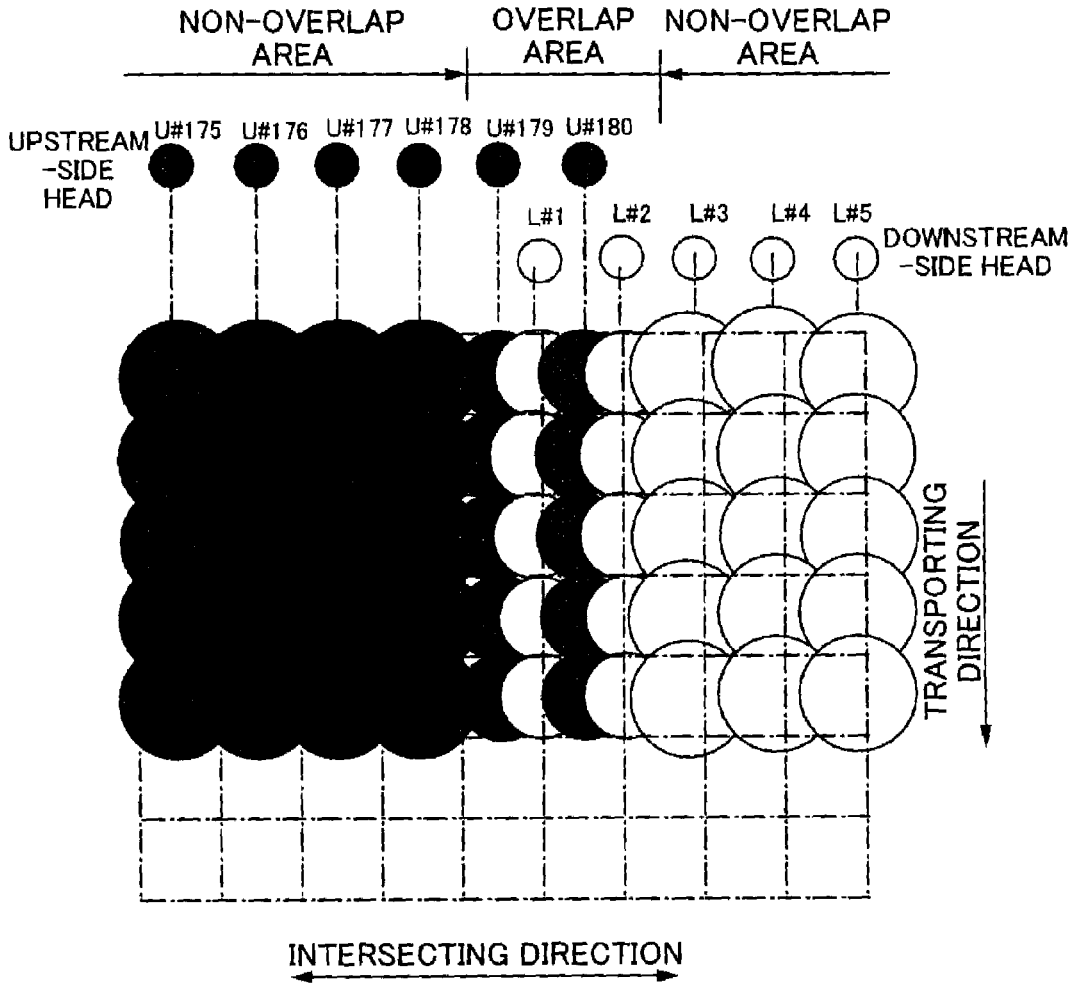
FIG. 12 is a diagram illustrating a concept of an image formed by causing each of two nozzles to eject ink onto one unit area.

FIG. 12 is a diagram illustrating a concept of an image formed by causing each of two nozzles to eject ink onto one unit area.

In a case where ink is ejected from each of two nozzles onto one unit area, a dot is further formed between dots formed with the nozzles in the overlap area by the first ink ejection method, as shown in FIG. 12. At that time, ink in an amount for forming the largest dot is ejected from the nozzles in the overlap area in which the amount of ink ejected is small. Compared with an image that is printed by the first ink ejection method, an image that is printed at that time has a smaller area of an underlying portion exposed between dots, and ink can be ejected throughout substantially the entire area. Thus, a portion formed with the nozzles in the overlap area can be printed at higher density than that of an image printed by the first ink ejection method. Accordingly, occurrence of density unevenness can be suppressed. Hereinafter, an ink ejection method for ejecting ink from each of two nozzles onto one unit area in this manner is referred to hereafter as a second ink ejection method.

Furthermore, in a case where the amount of ink ejected from the nozzles in the overlap area is larger than the amount of ink ejected from the nozzles in the non-overlap area, dots formed with the nozzles in the overlap area are larger than dots formed with the nozzles in the non-overlap area, and thus the density in the image becomes high only at that portion. In this case, the amount of ink ejected from the nozzles is reduced in either one of the nozzle row on the upstream side and the nozzle row on the downstream side in the overlap area.

Figure 13:
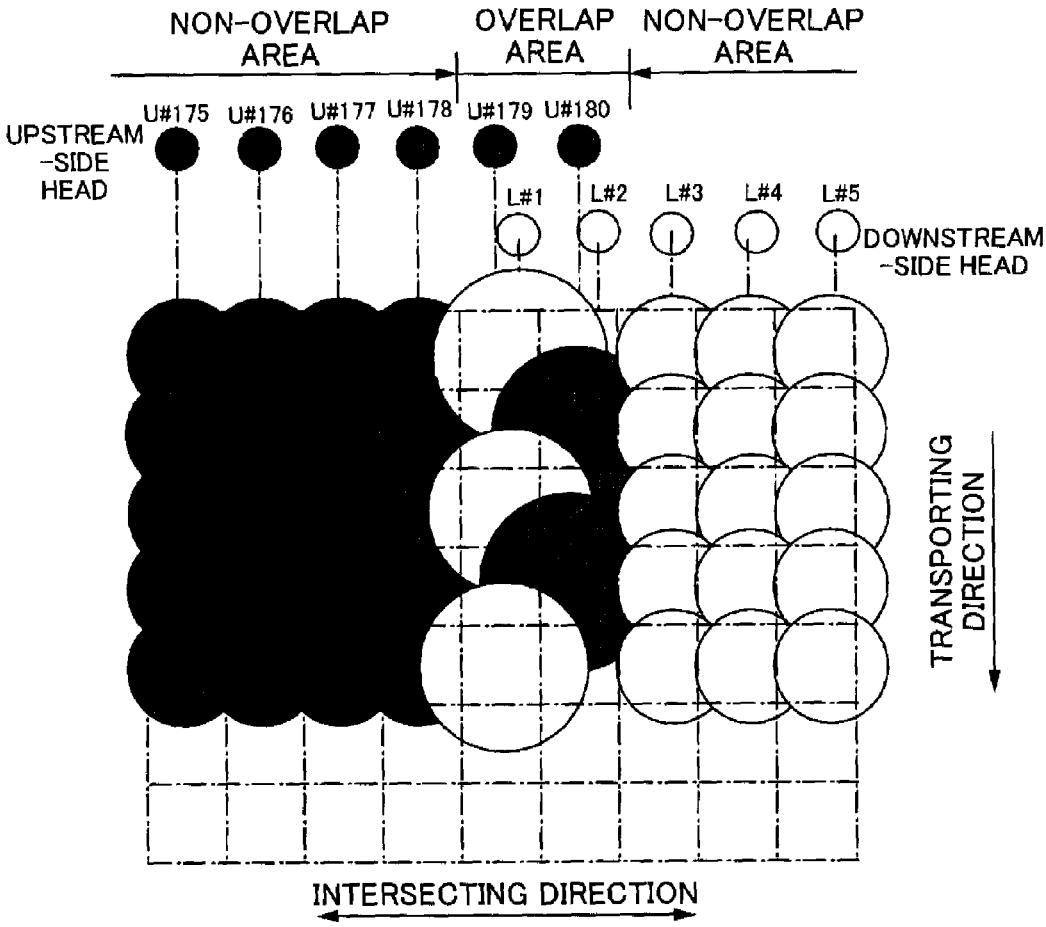
FIG. 13 is a diagram illustrating an example of an ink ejection method by which the amount of ink ejected from the nozzles is reduced in a nozzle row on the upstream side and a nozzle row on the downstream side in the overlap area.

FIG. 13 is a diagram illustrating an example of an ink ejection method by which the amount of ink ejected from nozzles is reduced in a nozzle row on the upstream side and a nozzle row on the downstream side in the overlap area.

In the example show in FIG. 13, among dot rows formed in the transporting direction with the nozzles in the overlap area, one dot row of adjacent dot rows is formed with the nozzle U#180 in the nozzle row on the upstream side, and the other dot row is formed with the nozzle L#1 in the nozzle row on the downstream side. Furthermore, in each dot row, a dot is formed at every other unit area in the transporting direction. When the number of dots formed with the nozzles in the overlap area is reduced in this manner, the density of an image printed with the nozzles in the overlap area can be lowered. Accordingly, occurrence of density unevenness can be suppressed. Hereinafter, an ink ejection method by which one of adjacent dot rows is formed with the nozzle U#180 in the nozzle row on the upstream side, the other dot row is formed with the nozzle L#1 in the nozzle row on the downstream side, and a dot is formed at every other unit area in the transporting direction, is hereafter referred to as a third ink ejection method.

Figure 14:
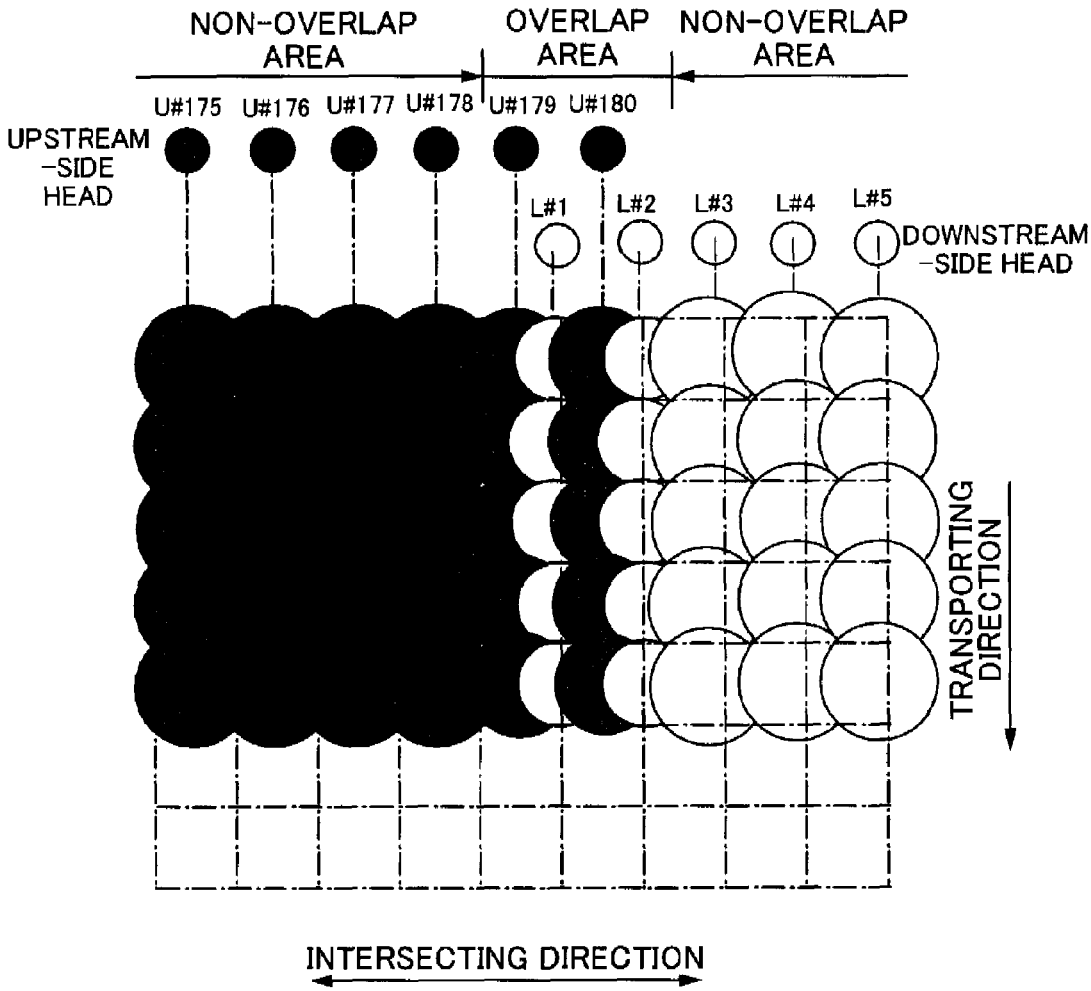
FIG. 14 is a diagram illustrating a concept of an image formed in a modified example of an ink ejection method in a case where the amount of ink ejected from the nozzles in the overlap area is smaller than the amount of ink ejected from the nozzles in the non-overlap area.
Figure 15:
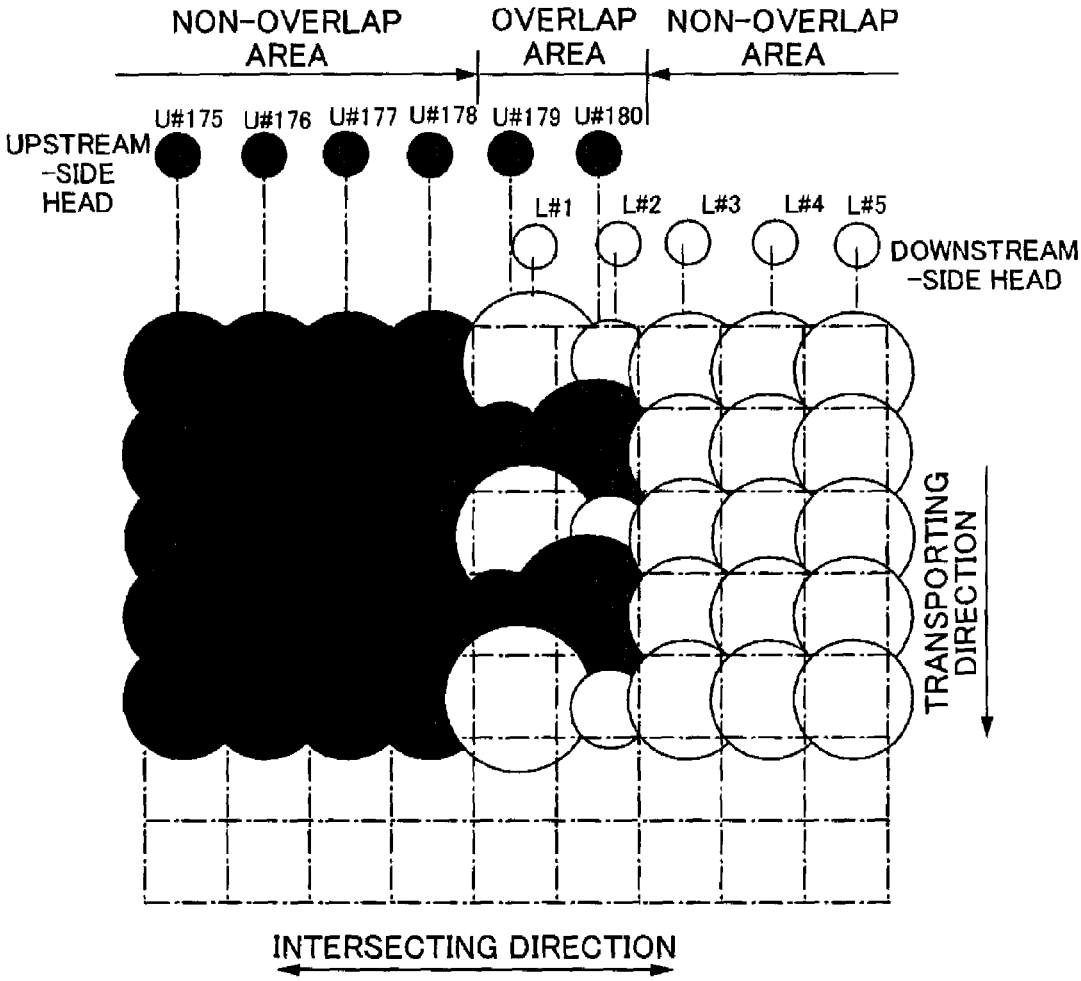
FIG. 15 is a diagram illustrating a concept of an image formed in a modified example of an ink ejection method in a case where the amount of ink ejected from the nozzles in the overlap area is larger than the amount of ink ejected from the nozzles in the non-overlap area.

FIG. 14 is a diagram illustrating a concept of an image formed in a modified example of an ink ejection method in a case where the amount of ink ejected from the nozzles in the overlap area is smaller than the amount of ink ejected from the nozzles in the non-overlap area. FIG. 15 is a diagram illustrating a concept of an image formed in a modified example of an ink ejection method in a case where the amount of ink ejected from the nozzles in the overlap area is larger than the amount of ink ejected from the nozzles in the non-overlap area.

In the second ink ejection method, in a case where the amount of ink ejected from the nozzles in the overlap area is smaller than the amount of ink ejected from the nozzles in the non-overlap area, ink in an amount for forming the largest dot is ejected from each of two nozzles onto one unit area. However, depending on the largest dot that can be formed with the nozzles in the overlap area, the amounts of ink ejected from the two nozzles may be different from each other. In the example in FIG. 14, ink in an amount for forming the largest dot is ejected from the nozzles U#179 and U#180 in the nozzle row on the upstream side in the overlap area, and ink in an amount smaller than that from the nozzles U#179 and U#180 in the nozzle row on the upstream side is ejected from the nozzles L#1 and L#2 in the nozzle row on the downstream side. At that time, ink in an amount for forming the largest dot may be ejected from the nozzles L#1 and L#2 in the nozzle row on the downstream side, and ink in an amount smaller than that from the nozzles L#1 and L#2 in the nozzle row on the downstream side may be ejected from the nozzles U#179 and U#180 in the nozzle row on the upstream side.

In the third ink ejection method, in a case where the amount of ink ejected from the nozzles in the overlap area is larger than the amount of ink ejected from the nozzles in the non-overlap area, among dot rows formed in the transporting direction, one dot row of adjacent two dot rows is formed with a nozzle in the nozzle row on the upstream side, and the other dot row is formed with a nozzle row on the downstream side. However, if necessary, a small dot may be formed in the other dot row with a nozzle in the nozzle row on the upstream side, and a small dot may be formed in the one dot row as a dot formed with the nozzle row on the downstream side. In the example shown in FIG. 15, one dot row of adjacent dot rows is constituted by a small dot formed with the nozzle U#179 in the nozzle row on the upstream side and a large dot formed with the nozzle L#1 in the nozzle row on the downstream side. Furthermore, the other dot row is constituted by a large dot formed with the nozzle U#180 in the nozzle row on the upstream side and a small dot formed with the nozzle L#2 in the nozzle row on the downstream side. When the sizes of dots are different from each other in this manner, the amount of ink ejected from the nozzles is reduced. In this case, the density of an image that is to be printed can be adjusted as appropriate, depending on the sizes of dots formed with the nozzles in the overlap area. Accordingly, occurrence of density unevenness can be suppressed more effectively.

The above-described ink ejection methods in the overlap area are set during production or the like based on the characteristics of nozzles in each head, and this information is stored in the memory of the printer 1. Next, a process of determining an ink ejection method is described.

Ejecting Method Determining Process

Figure 16:
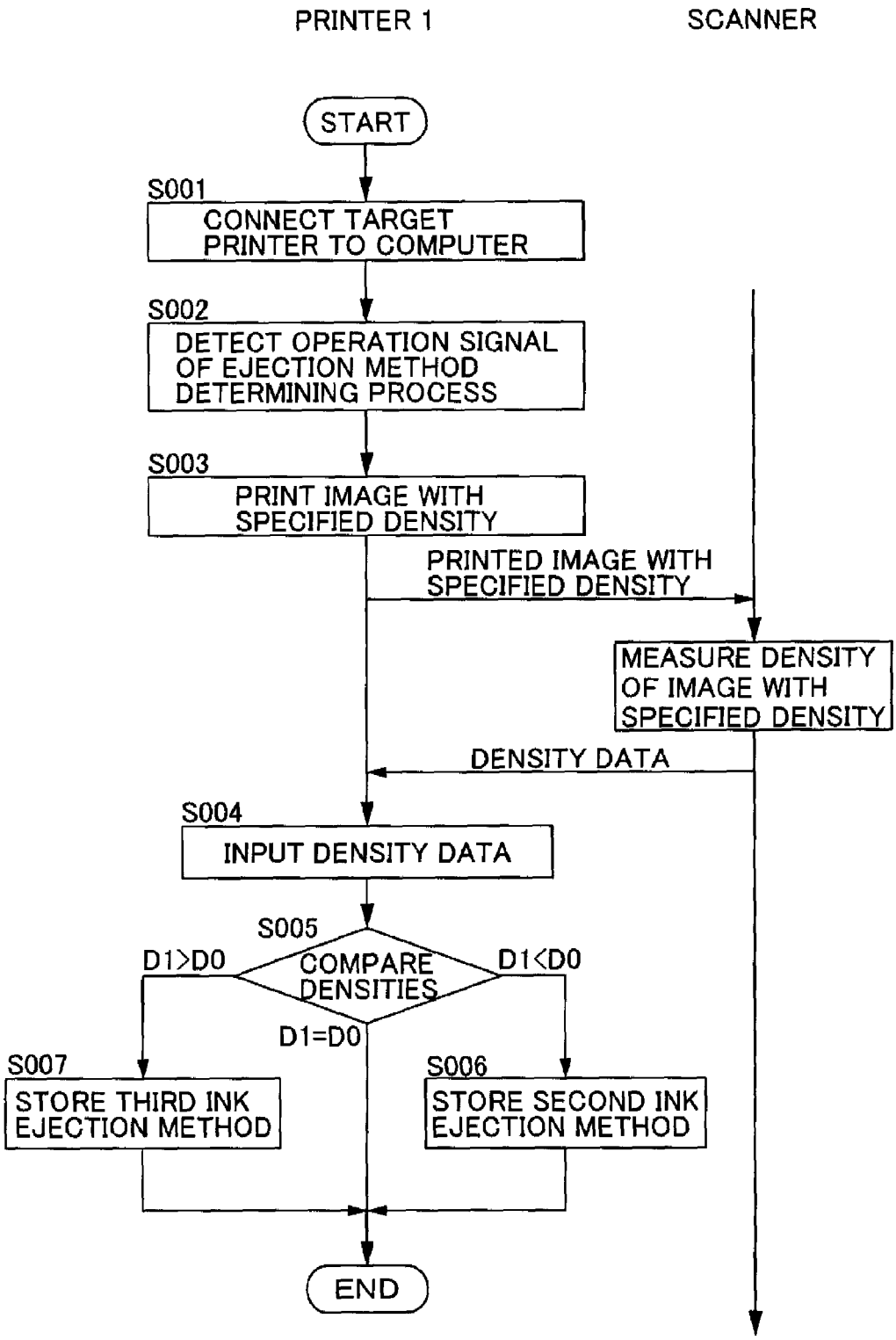
FIG. 16 is a flowchart illustrating a process of determining an ink ejection method.

FIG. 16 is a flowchart illustrating a process of determining an ink ejection method. Each process described below is performed by the controller 60 controlling the various units according to a program stored in the memory 63. This program includes a code for executing each process.

In the ejecting method determining process, first, the printer 1 that has been produced is connected to a computer installed at a production site, by a user or an operator in the production step, for example (S001).

When a signal for performing a process of determining the ink ejection method is input by an operator (S002), the printer 1 prints a specific density image based on print data for forming an image with a predetermined density (S003). Herein, the specific density image refers to data for printing a halftone image with predetermined uniform density. For example, in a case where tone of density is data indicated by the value 0 to 255 for each pixel, the specific density image refers to print data in which "128" is set for all pixels. Furthermore, in the printer immediately after production, the first ink ejection method is stored in the memory 63 as the ink ejection method information in the overlap area. Thus, the specific density image is printed by the first ink ejection method.

The operator measures the density of the printed specific density image, with a scanner installed at a production site or the like. At that time, the scanner measures the density, at a plurality of portions formed with ink ejected from a plurality of nozzles in the overlap area and a plurality of portions formed with nozzles in the non-overlap area in the printer 1.

In the printer 1 that has printed the specific density image, the wizard for determining the ejecting method operates, and information prompting input of density data is displayed on the display section 65.

When the density data is input by the operator that acquired the density data that has been measured with the scanner, according to the information on the display section 65 (S004), the controller 60 compares density data D1 at a plurality of portions formed with ink ejected from the nozzles in the overlap area and a reference value D0 based on density data at a plurality of portions formed with the nozzles in the non-overlap area (S005). Then, as a result of comparison between the density data D1 and the reference value D0, if the density data D1 is equal to the reference value D0, then the ejecting method determining process is ended. Herein, the reference value D0 refers to a density value that is centered on a measured value of density at the plurality of portions formed with the nozzles in the non-overlap area, and that has a predetermined tolerance range above and below the center.

If it is detected that the density data D1 is smaller than the reference value D0, and the density is low, then the second ink ejection method is stored in the memory 63 as the as the ink ejection method information (S006), and then the ejecting method determining process is ended. On the other hand, if it is detected that the density data D1 is higher than the reference value D0, and the density is high, then the third ink ejection method is stored in the memory 63 as the as the ink ejection method information (S007), and then the ejecting method determining process is ended.

Regarding the Printing Operation

Figure 17:
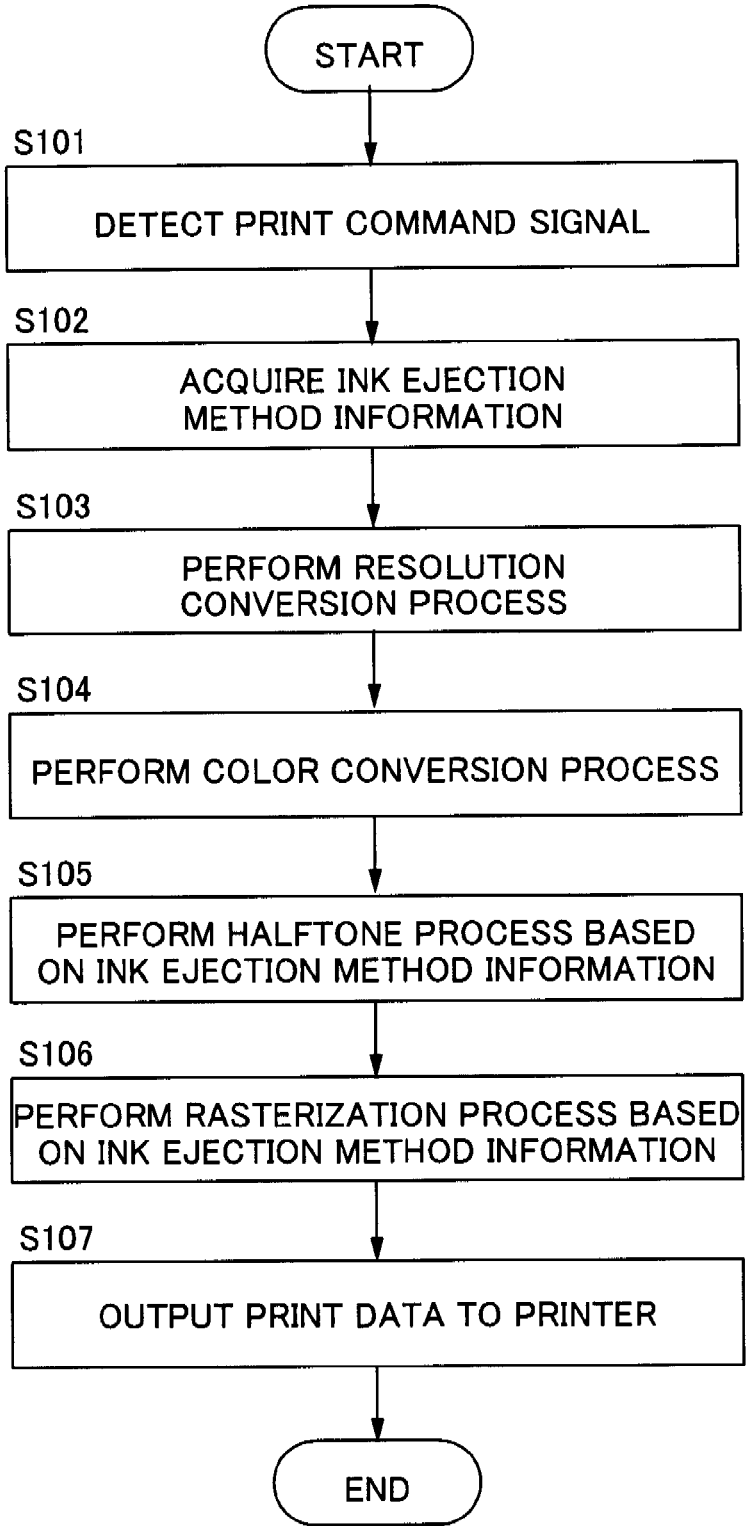
FIG. 17 is a flowchart of processes during printing.

FIG. 17 is a flowchart of processes during printing. Each process described below is performed by the computer 110 to which the printer 1 is connected and the printer 1 controlling the various units according to a program stored in the memory. This program includes a code for executing each process.

When the computer 110 in which an application program is operating detects a print command (S101), the computer 110 outputs image data to a printer driver, accesses the printer 1 connected thereto, and acquires ink ejection method information stored in the memory 63 (S102).

The printer driver performs a resolution conversion process in which image data received from the application program is converted to have a resolution for printing (S103).

Next, a color conversion process is performed in which each RGB pixel data of the RGB image data after the resolution conversion process is converted into data having multiple tone values (for example, 256 tones) expressed in CMYK color space (S104).

Then, a halftone process is performed in which the CMYK pixel data having the multiple tone values after the color conversion process is converted into CMYK pixel data having few tone values that can be expressed by the printer 1 (S105). At that time, pixel data of pixels formed with the nozzles in the overlap area is converted based on the ink ejection method in the overlap area that has been acquired in advance.

Next, a rasterization process is performed in which the CMYK image data after the halftone process is rearranged in the data order in which data is to be transferred to the printer 1 (S106). At that time, nozzles that are to be used are specified among the nozzles in the overlap area based on the ink ejection method in the overlap area that has been acquired in advance, and print data that can be printed by the ink ejection method stored in the memory 63 is generated. The data after the rasterization process is output to the printer 1 as the print data described above.

With this printer 1, the ink ejection method from the nozzles in the overlap area is determined based on the density of the printed specific density image, and thus the ink ejection method can be determined according to the ejection characteristics of ink from the nozzles in the overlap area. In particular, the position of a nozzle in a particular nozzle row in the overlap area and the position of a nozzle in another nozzle row are different from each other in the intersecting direction, and thus ink ejected from the nozzle in the particular nozzle row and ink ejected from the nozzle in the other nozzle row can be ejected onto different positions on a medium. Thus, a plurality of types of ink ejection methods can be set, so that a more appropriate ink ejection method can be determined according to the ejection characteristics of ink from the nozzles. Accordingly, occurrence of density unevenness can be suppressed.

Furthermore, the ink ejection method from the nozzles in the overlap area is determined based on the density of an image formed with ink ejected from the nozzles in the overlap area, so that an appropriate ink ejection method can be determined according to an actually formed image.

Furthermore, the specific density image is formed by causing ink to be ejected based on print data for causing the nozzles to eject the same amount of ink, and thus it is possible to easily judge whether or not a proper image is formed, by judging whether or not the printed specific density image is printed at substantially uniform density.

Furthermore, in the specific density image, a dot formed with ink ejected from a nozzle in a particular nozzle row in the overlap area and a dot formed with a nozzle in another nozzle row are alternately arranged. Thus, the ejection characteristics of ink from the nozzle rows are less likely to be conspicuous, so that this method is appropriate as an ink ejection method for printing an image. Since the ink ejection method in the overlap area is determined based on the specific density image printed by this ink ejection method, occurrence of density unevenness can be effectively suppressed, and a good image can be printed.

Furthermore, in a case where the density of the formed specific density image is low, two dots at different positions in the intersecting direction are formed at a unit area. Thus, the density of an image that is to be formed can be increased.

Furthermore, when the size of a dot formed with ink ejected from a nozzle in a particular nozzle row is different from the size of a dot formed with ink ejected from a nozzle in another nozzle row, the density of an image that is to be formed can be changed between multiple levels.

Furthermore, in a case where the density of the specific density image is higher than a preset density, and the amount of ink ejected from nozzles is reduced in either one of a particular nozzle row and another nozzle row, the density of an image that is to be formed can be reliably lowered.

The foregoing embodiment describes an example in which the specific density image printed with the printer 1 is read with a scanner installed at a production site or the like, but this is not a limitation.

Figure 18:
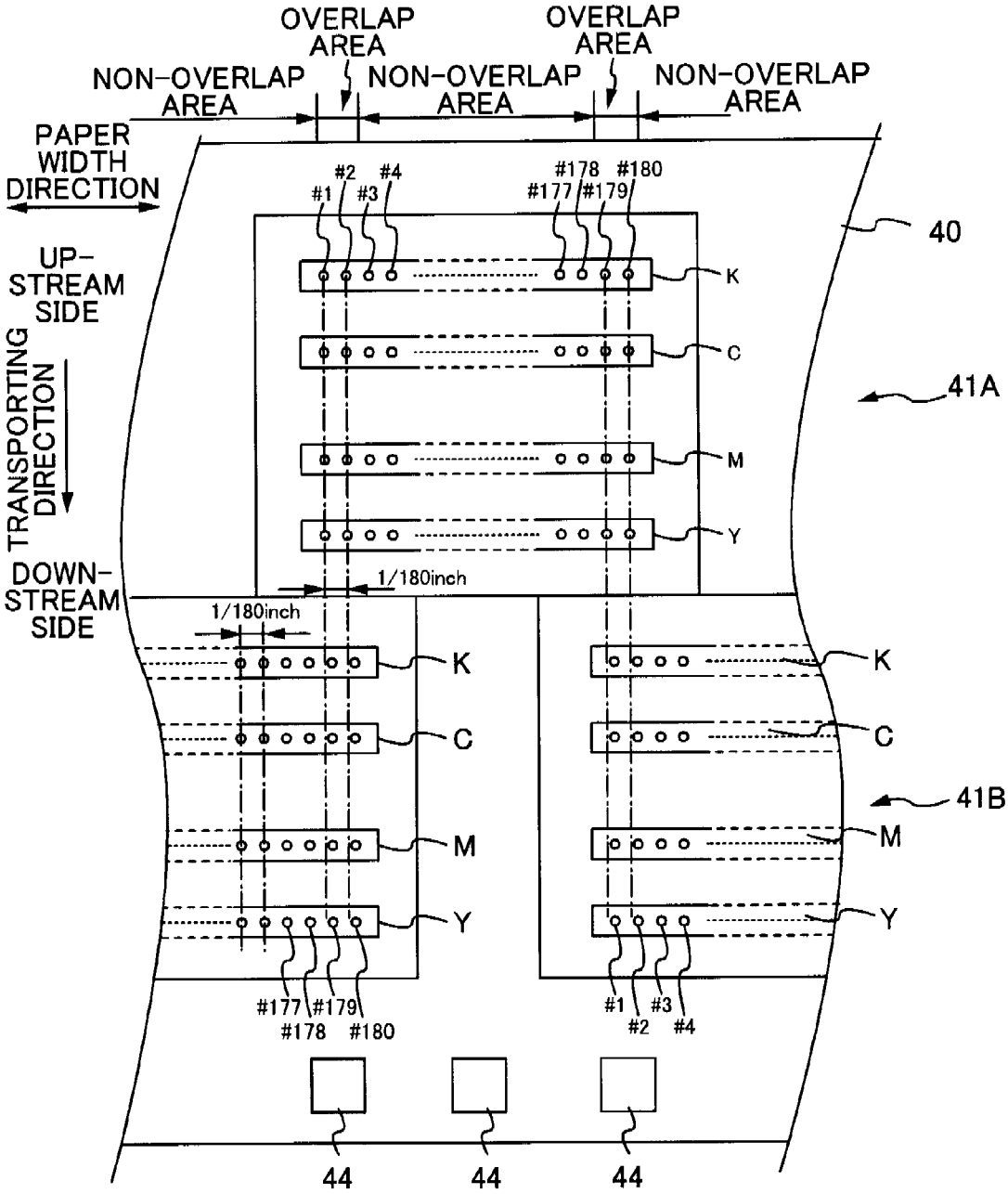
FIG. 18 is a diagram illustrating an example of a head unit in a case where a printer 1 is provided with read sensors.

FIG. 18 is a diagram illustrating an example of a head unit in a case where the printer 1 is provided with read sensors. As shown in FIG. 18, the head unit 40 is provided with a plurality of read sensors as detecting sections for detecting density. At that time, read sensors 44 are reflection-type optical sensors that are provided on the downstream side of the overlap areas and the non-overlap areas. With this printer 1, in a state where a specific density image is printed and the density is measured at the downstream side, the controller 60 may determine the ink ejection method based on the density data obtained using each read sensor and store this information in the memory 63. Furthermore, in a case where the printer 1 is integrally formed with a document reading device of a flat bed type, or a document reading device provided with a document feeder, for example, an image printed with the printer 1 may be read by the document reading device integrally provided with the printer 1, and the controller 60 may determine the ink ejection method based on the read density data and store this information in the memory 63.

Other Embodiments

The foregoing embodiment mainly describes the printing system, but it would be appreciated that the embodiment includes the disclosure of the printer 1, printing apparatuses, and printing methods, for example.

Moreover, although the printing system and the like as one embodiment are described, the foregoing embodiment is for the purpose of elucidating the invention, and is not to be interpreted as limiting the invention. The invention can of course be altered and improved without departing from the gist thereof and includes functional equivalents. In particular, embodiments described below are also included in the invention.

In a case where an image formed with ink ejected from the nozzles in the overlap area contains a high density portion with density higher than a preset density and a low density portion with density lower than the preset density, the ink ejection method for a case where the density of an image is higher than the preset density may be applied to the nozzles used for forming the high density portion, and the ink ejection method for a case where the density of an image is lower than the preset density may be applied to the nozzles used for forming the low density portion.

Regarding the Printer

The foregoing embodiments describe the printer 1 as a printing apparatus, but this is not a limitation. For example, technology similar to that of the present embodiments can also be adopted for various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Moreover, methods and manufacturing methods of these are also within the scope of application.

Regarding the Ink

In the foregoing embodiments, a dye ink or a pigment ink is ejected from the nozzles of the printer 1. However, the ink that is ejected from the nozzles is not limited to these inks.

Regarding the Ink Colors Used for Printing

The foregoing embodiments describe an example of multicolor printing in which four color inks cyan (C), magenta (M), yellow (Y), and black (K) are ejected onto the paper S to form dots, but the ink colors are not limited to these. For example, the number of ink colors may be six by using, for example, light cyan (LC) and light magenta (LM) in addition to these ink colors, or may be eight by additionally using light black LK and light-light black LLK. Furthermore, settings may be applied in which a printing mode using four color inks and a printing mode using six or eight color inks can be switched. In this case, it is preferable that an image with a different thinning process in each recording method is printed for the number of the ink colors, and a thinning process setting table appropriate for each ink color is provided.

Alternatively, it is also possible to perform single-color printing using only one of these four ink colors.

What is claimed is:

1. A method of determining an ink ejection method, comprising:

transporting a medium in a transporting direction;

forming an image with a nozzle unit having a plurality of nozzle rows in which a plurality of nozzles for ejecting ink are arranged at a predetermined interval in an intersecting direction intersecting the transporting direction, wherein the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction; and determining an ink ejection method from the nozzles in the overlap area, based on a density of the image.

2. A method of determining an ink ejection method according to claim 1, wherein the image is formed with ink that has been ejected from the nozzles in the overlap area.

3. A method of determining an ink ejection method according to claim 1, wherein the nozzles form an image based on print data, and the image is a specific density image that has been formed based on the print data for forming an image with a predetermined density.

4. A method of determining an ink ejection method according to claim 3, wherein the specific density image is formed by causing ink to be ejected from the nozzles such that a dot to be formed on the medium with ink ejected from the nozzle in the particular nozzle row in the overlap area and a dot to be formed on the medium with ink ejected from the nozzle in the other nozzle row are alternately arranged in the transporting direction.

5. A method of determining an ink ejection method according to claim 1, wherein in a case where a density of the image is lower than a preset density, ink is caused to be ejected from the nozzle in the particular nozzle row and the nozzle in the other nozzle row in the overlap area.

6. A method of determining an ink ejection method according to claim 5, wherein an amount of ink caused to be ejected is different between the nozzle in the particular nozzle row and the nozzle in the other nozzle row in the overlap area.

7. A method of determining an ink ejection method according to claim 1, wherein in a case where a density of the image is higher than a preset density, an amount of ink caused to be ejected from the nozzle is reduced in either one of the particular nozzle row and the other nozzle row in the overlap area.

8. A method of determining an ink ejection method according to claim 1, further comprising detecting a density of the image.

9. A method of determining an ink ejection method according to claim 1, wherein in a case where an image that has been formed with ink that has been ejected from the nozzles in the overlap area contains a high density portion with a density higher than a preset density and a low density portion with a density lower than the preset density, an ink ejection method for a case where density of an image is higher than the preset density is applied to the nozzle used for forming the high density portion, and an ink ejection method for a case where a density of an image is lower than the preset density is applied to the nozzle used for forming the low density portion.

10. A printing apparatus, comprising:

(A) a transporting section that transports a medium in a transporting direction;

(B) a nozzle unit having a plurality of nozzle rows in which a plurality of nozzles for ejecting ink are arranged at a predetermined interval in an intersecting direction intersecting the transporting direction, wherein the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction; and (C) a controller that determines an ink ejection method from the nozzles in the overlap area, based on a density of an image that has been formed with ink that has been ejected onto the medium.

11. A method of manufacturing a printing apparatus, comprising:

transporting a medium in a transporting direction using the printing apparatus;

forming an image with a nozzle unit having a plurality of nozzle rows in which a plurality of nozzles for ejecting ink are arranged at a predetermined interval in an intersecting direction intersecting the transporting direction, wherein the nozzle unit is provided in the printing apparatus, the plurality of nozzle rows are arranged parallel to each other, one end side in the intersecting direction in a particular nozzle row and the other end side in the intersecting direction in another nozzle row are overlapped with each other in the transporting direction so as to form an overlap area, and in the overlap area, the nozzle in the particular nozzle row and the nozzle in the other nozzle row are at different positions in the intersecting direction;

determining an ink ejection method from the nozzles in the overlap area, based on a density of the image; and causing a memory provided in the printing apparatus to store information relating to the determined ink ejection method.

* * * * *